United States Patent [19]

Powers, III

[11] 4,100,084

[45] Jul. 11, 1978

[54] PREPARATION OF OVERBASED METAL NAPHTHENATE LUBRICATING OIL COMPOSITIONS

[75] Inventor: William J. Powers, III, Port Arthur, Tex.

[73] Assignee: Texaco Inc., New York, N.Y.

[21] Appl. No.: 767,000

[22] Filed: Feb. 9, 1977

[51] Int. Cl.[2] ..... C10M 1/24; C10M 3/18; C10M 5/16; C10M 0/22

[52] U.S. Cl. ..... 252/39; 252/18

[58] Field of Search ..... 252/18, 39

[56] References Cited

U.S. PATENT DOCUMENTS

| | | | |
|---|---|---|---|
| 2,616,905 | 11/1952 | Asseff et al. | 252/39 |
| 2,616,925 | 11/1952 | Asseff et al. | 252/39 |
| 2,695,910 | 11/1954 | Asseff et al. | 252/39 |
| 2,865,956 | 12/1958 | Ellis et al. | 252/39 |

*Primary Examiner*—Delbert E. Gantz
*Assistant Examiner*—Irving Vaughn
*Attorney, Agent, or Firm*—Thomas H. Whaley; Carl G. Ries; Henry W. Archer

[57] ABSTRACT

A method for the preparation of overbased metal naphthenates of improved clarity and filterability by reacting a mixture of an oil soluble metal naphthenate, and a metal hydroxide in a light hydrocarbon-alcohol-nonpolar diluent oil solvent medium with carbon dioxide at a temperature of 140 to 155° F using a mole ratio of metal hydroxide to metal naphthenate ranging from 1:1 to 10:1 and a $CO_2$ to metal naphthenate mole ratio of 0.75 to 1.1, allowing the mixture to stand for 1 to 100 hours; then filtering the resulting carbonated mixture and recovering the desired composition wherein the degree of overbasing of the naphthenate ranges from 1 to 10.

4 Claims, No Drawings

PREPARATION OF OVERBASED METAL NAPHTHENATE LUBRICATING OIL COMPOSITIONS

BACKGROUND OF THE INVENTION

1. Field of the Invention

This invention relates to the preparation of lubricating oil compositions containing overbased metal naphthenates.

2. Description of the Prior Art

Overbased metal salts of organic acids which contain an amount of metal in excess of that theoretically required to replace the acidic hydrogen atoms of the acids have found utlity as components of lubricating oil composition. These salts impart to the lubricating compositions an alkaline reserve which neutralizes sulfur containing and other acids formed during combustion of the fuel thereby reducing corrosion of the engine and decreasing wear of piston rings and cylinders.

Various methods for producing metal naphthenates are already known such as those described in U.S. Pat. Nos. 2,938,828; 2,865,956 and Japanese Pat. Nos. 48,094,814; 48,084,815 and 49,010,906.

Although these prior art methods can produce highly overbased metal naphthenate lube oil compositions, they often have the drawback of having relatively slow filtration rates thereby requiring costly and extensive filtration apparatus in order to obtain any meaningful production. Filtration of the final overbased naphthenate lube oil composition is normally necessary since customers require a clear solution and the product in a crude state often contains considerable solids predominantly undispersable, agglomerated calcium carbonate particles which require removal.

SUMMARY OF THE INVENTION

The invention pertains to a method of producing overbased metal naphthenate lubricating oil compositions which have superior filtration properties, i.e. are readily filterable under conditions which produce a clear product.

The reactions occurring in the method can be summarized as follows:

Preparation of the Metal Naphthenate $$2RCO_2H + M(OH)_2 \xrightarrow[\text{optional}]{\text{solvent}} (RCO_2)_2M + H_2O \quad 1)$$

Overbasing $$(RCO_2)_2M + XM(OH)_2 \xrightarrow[\text{solvent}]{CO_2} (RCO_2)_2M \,.\, XMCO_3 \quad 2)$$

In the above, X ranges from 1 to 10. R represents a hydrocarbyl radical having from 15 to 40 carbon atoms, M may be any divalent metallic ion but preferably is an alkaline earth metal such as, but not limited to $Ca^{+2}$, $Ba^{+2}$, and $Sr^{+2}$. For the sake of simplicity however, the invention will be illustrated mainly with reference to the preparation of calcium naphthenate-containing compositions. In the above equations, isolation of the normal metal naphthenate $[(RCO_2)_2M]$ is optional; the entire amount of $M(OH)_2$ may be added initially.

More specifically, the method of the invention comprises forming a clarified overbased metal naphthenate lubricating oil composition by contacting an initial mixture of metal naphthenate, a metal hydroxide, a hydrocarbon lubricating oil, and an alcohol selected from the group consisting of alkanol and alkoxyalkanol having a carbon number from 1 to 5 with carbon dioxide at a temperature of 140°–155° F; allowing the mixture to stand for 1 to 100 hours, clarifying the resultant mixture via filtration and recovering the clarified overbased alkaline earth metal naphthenate composition from the filtrate.

DETAILED DESCRIPTION OF THE INVENTION

In detail, the method of the invention comprises forming a clarified overbased metal naphthenate lubricating oil composition having a metal ratio greater than 1 and up to 10 and a total base number (TBN) as defined by ASTM D 2896 of at least about 50 and up to 500 or higher, desirably between about 280 and 450, said method comprising first forming an initial reaction mixture, preferably having a water content less than 1 wt. %, composed of the following ingredients:

a. An oil soluble metal naphthenate reactant having a metal ratio from 1 to 2. The acids from which the naphthenate reactants are derived are advantageously of a molecular weight of between about 230 and 600;

b. A metal hydroxide.

c. An alcohol selected from the group consisting of alkanol and alkoxylated alcohol having a carbon number from 1 to 5;

d. A hydrocarbon lubricating oil having an SUS viscosity at 100° F. of between about 50 and 300;

e. Optionally and preferably a volatile inert liquid hydrocarbon diluent having a boiling point between about 150° to 300° F.

In examples of the practise of the invention, the naphthenic acid, diluent oil, hydrocarbon diluent and one equivalent of slaked lime were charged to a nitrogen blanketed 3-liter, 3-neck flask fitted with an air driven stainless steel stirrer and a reflux condenser equipped with a water separator. The stirrer was started and the flask was heated until overhead water formation ceased. The crude soap mixture was then transferred to a 2000 ml. Parr stirred autoclave fitted with two turbine impellers. The remaining lime and the methanol were added. The mixture was heated to 140°–155° F. $CO_2$ was added through a sparger. During runs at greater than 6:1 overbasing ratios, the reactor system was bled, as required, to hold reactor pressure at a maximum of 10 psig. This resulted in a substoichiometric charge of $CO_2$, basis metal hydroxide. The previously recognized phenomenon referred to as "overcarbonation" was found not to occur when overbasing ratios of less than 6 moles $M(OH)_2$/mol metal naphthenate were used, but does appear to occur at higher overbasing ratios. Overcarbonation must be avoided to assure that the product is filterable. After the $CO_2$ charge was complete, the temperature was held at 140°–155° F for 30 minutes. Five percent by weight of a filteraid was added and the product was filtered through blotter paper in a pressure bomb filter. The product was then stripped on a rotary vacuum stripper using a bath temperature of 250° F. Further details concerning preparation of five bench scale batches of overbased calcium naphthenate are presented in Table II, together with tests on the products.

Two pilot unit batches of the 10:1 calcium carbonate overbased calcium soap were made. The procedure was the same as that used for the bench scale batches except that both the crude soap preparation and the overbasing reaction were carried out in a 10-gallon reactor and the above described admix filtration was carried out on a 2 sq. ft. Sparkler filter precoated with 0.5 lbs of a filteraid. Details are shown in Tables III and IV.

Unexpectedly, it was found that an aging step involving storing of the mixture in an air blanketed vessel for 1 to 100 hours did not significantly affect the filtration rate and in some cases improved it. This phenomenon is not understood but is a part of this invention.

The filtration of the crude overbased naphthenate lubricating oil composition is normally conducted through a stainless steel or cloth plate which may be precoated with filter materials such as diatomaceous silica, diatomaceous silica mixed with wood fibers, cellulose derived from wood pulp, natural glass derived from volcanic action and etc., at a temperature between about 50° and 200° F. Further, to aid filtration, filter aids are preferably employed in the crude mixture in amounts of between 1.0 and 15.0 wt. % based on the crude mixture. Standard filter apparatuses may be employed such as frame filters and bomb filters, preferably filtration is conducted under pressure to speed filtration, e.g., between about 10 and 100 psig. Normally, from a commercial standpoint filtration rates greater than 1.0 gals./hr/ft.$^2$ of filter area are acceptable.

The hydrocarbon lubricating oil employed may be any liquid hydrocarbon material having lubricating properties (e.g. mineral oils) and an SUS viscosity of between about 50 and 300 at 100° F. but normally is a paraffinic base or naphthenic base lubricating oil, preferably having an SUS viscosity at 100° F. of between about 75 and 150.

Specific examples of the alcohols contemplated herein are methanol, ethanol, propanol, butanol, methoxyethanol and ethoxyethanol. Methanol is the most preferred.

In regard to the preferably employed volatilizable hydrocarbon diluent, any inert liquid hydrocarbon material may be employed having boiling points substantially below the lubricating oil vehicle and the decomposition temperature of the reaction mixture. Specifically, examples of such materials are heptane, isoheptane, benzene, toluene, xylene, petroleum naphthas having a boiling point of between about 150° and 300° F.

Typical tests on a naphthenic acid suitable for use in this invention are shown in Table I.

TABLE I

| | |
|---|---|
| Gravity, API | 14.3 |
| Neut. No. | 154 |
| Sap. No. | 142.9 |
| Non Sap., Wt. % | 19.2 |
| Strong Acid No. | None |
| Mol. Wt., Calc. Neut. No. | 362 |
| Sulfate | None |

TABLE II

BENCH SCALE PREPARATION OF OVERBASED CALCIUM SOAPS OF NAPHTHENIC ACIDS

| Overbasing Ratio | 4/1 | 6/1 | 8/1 | 10/1 | 10/1 |
|---|---|---|---|---|---|
| Charge Stock Wts, gm | | | | | |
| Naphthenic acid | 362 | 181 | 181 | 181 | 181 |
| Slaked lime | 185 | 129.5 | 166.5 | 203.5 | 203.5 |
| Dehexanized raffinate gasoline | 350 | 260 | 350 | 430 | 430 |
| $CH_3OH$ | 62 | 47 | 63 | 79 | 79 |
| Diluent Oil | 362 | 181 | 205 | 237 | 237 |
| $CO_2$ | 95 | 73 | 80 | 99 | 99 |
| $CO$ /$Ca(OH)_2$ mol ratio | 1.1 | 1.1 | 0.9 | 0.9 | 0.9 |
| Reaction Conditions | | | | | |
| Soap Formations | | | | | |
| Temp. F | 157–205 | 200–210 | 180–200 | 190–195 | 195 |
| Time, hrs. | 2 | 2 | 1 | 1.5 | 2 |
| Mixed Speed, rpm | 600 | 750 | 750 | 750 | 750 |
| Overbasing | | | | | |
| Temp., F | 140–157 | 140–150 | 135–140 | 135–140 | 135–140 |
| $CO_2$ Add'n time, hrs | 2.5 | 1 | 1 | 1.1 | 0.9 |
| Mixer Speed, rpm | 2000 | 1900 | 2000 | 2000 | 2000 |
| Product Yields, gm | | | | | |
| Crude overbased Soap | 1180 | 794 | 999 | 1190 | 1214 |
| Aqueous overhead | 6 | 1.4 | 1.3 | 0.3 | 0.1 |
| Filtration | | | | | |
| Admix, gm | 59 | 40 | 50 | 60 | 61 |
| Filtrate, gm | 847 | 562 | 663 | 723 | 824 |
| Rate, gal/hr/ft$^2$ | 1.2 | 6.4 | 1.5 | 0.5 | 1.8 |
| Throughput, gal/ft$^2$ | 2.3 | 1.6 | 2.0 | 2.0 | 2.3 |
| Stripped Filtrate, gm | 687 | 355 | 388 | 442 | 489 |
| Product | | | | | |
| TBN | 218 | 256 | 336 | 378 | 385 |
| TBN, Calc. | 297 | 379 | 420 | 455 | 455 |
| % of Theory | 73.4 | 67.5 | 80.0 | 83.1 | 84.6 |
| Viscosity, 210° F, SUS | 163.6 | 142.9 | 212.4 | 527.5 | — |
| Appearance of 25% Blend in solvent neutral oil | — | Sl.Haze | Bright & Clear | Bright & Clear | Bright & Clear |

[1]Mols excess lime charged/mol calcium naphthenate prepared
[2]Mols $CO_2$/Mol excess lime

TABLE III

PILOT UNIT PREPARATIONS

| | | |
|---|---|---|
| Charge Composition, wt. % | | |
| Reactants | | |
| Naphthenic Acid | 12.7 | 12.7 |
| Slaked lime | 28.4 | 28.4 |
| $CO_2$ | 6.5 | 6.5 |
| Diluent | | |
| Diluent Oil | 16.7 | 16.7 |
| Solvents | | |
| Dehexanized raffinate gasoline | 30.2 | 30.2 |
| $CH_3OH$ (Absolute) | 5.5 | 5.5 |
| Total | 100.0 | 100.0 |
| Reaction Conditions | | |
| Soap Formation | | |
| Heat to Reflux, hrs | 1.0 | 1.5 |
| Temp, F | 100–172 | 107–198 |
| Reflux Period, hrs | 3.0 | 3.0 |
| Temp, F | 172–191 | 198–206 |
| Cooling to 140 F, hrs | 1.0 | 1.0 |
| Carbonation | | |
| $CO_2$ Chg Time, hrs | 4.5 | 3.5 |
| Temp, F | 140–156 | 138–142 |
| Bomb Filtration Data | | |
| Rate, gal/hr/ft$^2$ | Not Bomb | 0.9 |
| Throughput, gal/ft$^2$ | Filtered | 1.1 |
| Sparkler Filtration | | |

TABLE III-continued

| PILOT UNIT PREPARATIONS | | |
|---|---|---|
| Rate, lbs/hr/ft$^2$ | 3.5 | 2.7 |
| Throughput, lbs/ft$^2$ | 11.0 | 15.1 |
| Naphthenate | | |
| Yield, lbs | 13.4 | 15.0 |
| Wt % basis Naphthenic Acid | 148 | 166 |

TABLE IV

| PILOT UNIT PRODUCT INSPECTION TEST RESULTS | | |
|---|---|---|
| Sp Gr 60/60 F | 1.1734 | 1.1945 |
| Viscosity, SUS 210° F | 567 | 737 |
| Flash, COC, F | 340 | 375 |
| Color, ASTM D 1500 | 5.5 dil | — |
| TBN | 376 | 375 |
| Calculated | 455 | 455 |
| TBN, % of Theory | 82.6 | 82.4 |
| Calcium, wt % | 12.4 | 12.4 |
| Calculated | 16.2 | 16.2 |
| Appearance, 25 vol. % Blend in solvent neutral oil | Bright & Clear | |

TABLE V

| DIESEL CYLINDER OILS COMPOSITION AND BENCH PERFORMANCE TEST RESULTS | | | |
|---|---|---|---|
| Composition, wt. % | A | B | C |
| D | 68.8 | 65.1 | 71.1 |
| E | 0.5 | 0.5 | 0.5 |
| F | 1.0 | 1.0 | 1.0 |
| G | 9.8 | 9.8 | 9.8 |
| H | 3.4 | 3.4 | 3.4 |
| I | 6.5 | 6.5 | 6.5 |
| J | 10.0 | — | — |
| K | — | 13.7 | — |
| L | | | 7.7 |
| Sp. Grav., 60/6° F | 0.952 | 0.951 | 0.950 |
| Kin. Visc a 210° F, Cs. | 21.81 | 21.74 | 22.01 |
| Total Base Number | 66.0 | 69.6 | 70.0 |
| 6 Hr. 625° F Panel Coker Test | | | |
| Deposits, mg. | 10.6 | 13.7 | 6.9 |
| Color/Streaks | 45/v.sl. | 50/sl. | 35/sl. |
| 4-Ball E.P. Value,KG | 60.5 | 69.4 | 68.7 |
| Weld Pt, kg. | 251 | 282 | 251 |
| 4-Ball Wear Test 5 Hr. 1800 RPM Scar Diam, mm | | | |
| Fresh | 0.313 | 0.337 | 0.342 |
| After Panel Coker | 0.333 | 0.375 | 0.364 |

D - Lubricating Oil
E - Zinc dialkyldithiophosphate
F - B-hydroxyethylpolyisobutylene dithiophosphonate
G - 55 wt% 10% $CaCO_3$ overbased sulfurized calcium alkylphenolate 45 wt % mineral oil
H - 50 weight percent of 2/1 $CaCO_3$ overbased sulfurized calcium alkyl phenolate and 50% diluent oil having an API gravity of 27.0 to 31 and an SUS viscosity of 96–104 at 100° F
I - 60% Nominal 18:1 overbased calcium sulfonate 40% mineral oil
J - Overbased calcium naphthenate (TBN250) made by OSCA Kaguku
K - Overbased calcium naphthenate (TBN 207) made by Shell (N70C)
L - Overbased calcium naphthenate of the invention

Bench Performance Testing Results

Data on three diesel cylinder lubricants formulated using three different overbased naphthenates, Osca 255N (Osca Kagaku Kogyo KK), Shell N-70C and that of the invention (nominal 380 TBN) are presented in Table V. All finished lubricants were blended so as to exhibit a nominal Total Base Number of 70. The naphthenates of the invention had the following advantages:

(1) Since higher TBN's can be realized by employing the technology herein described, a low overbased naphthenate dosage is required when the instant composition is used (Formulation C, Table V).

(2) The formulation of the invention (C) was definitely superior in the Panel Coker Test, both in the level of deposits observed and in used oil color.

(3) The formulation of the invention (C) was superior in EP properties to the OSCA 255N containing formulation (A) and equivalent to the Shell N70C containing formulation (B).

While the invention has been described in detail with particular reference to preferred embodiments thereof, it will be understood that variations and modifications can be effected within the concept of the invention as described hereinabove and as defined in the appended claims.

We claim:

1. A method of preparing a clarified overbased metal naphthenate lubricating oil composition comprising contacting a reaction mixture of a metal naphthenate reactant having a metal ratio of from about above 1 to 10, an alkaline earth metal hydroxide, a hydrocarbon lubricating oil and an alcohol selected from the group consisting of alkanols and alkoxyalkanols having from 1 to 5 carbon atoms with carbon dioxide at a temperature between about 140° and 155° F., allowing the mixture to stand in an air blanketed vessel for 1 to 100 hours; subsequently filtering the resultant naphthenate product and recovering said clarified overbased metal naphthenate composition from the filtrate, said metal naphthenate being derived from naphthenic acid of a molecular weight between about 230 and 600, said contacting employing between about 1 and 10 moles of hydroxide per mole of said metal naphthenate reactant, between about 0.75 and 1.1 moles $CO_2$ per mole of hydroxide, said hydrocarbon lubricating oil being present in a weight ratio of between about 1:1 and 6:1 diluent oil to metal naphthenate reactant, and said alcohol being present in a weight ratio of between about 1:2 and 1:6 alcohol to naphthenate reactant.

2. The method in accordance with claim 1 wherein the initial reaction mixture also contains an inert, votalizable hydrocarbon liquid diluent present in a weight ratio of between 1:1 and 3:1 of said diluent to said naphthenate reactant.

3. The method in accordance with claim 2, wherein said naphthenate reactant is a calcium naphthenate of a molecular weight of about 760, said alcohol is methanol, said volatilizable diluent is a material having a boiling point of between about 150° and 300° F and said lubricating oil diluent is a solvent neutral oil.

4. The method in accordance with claim 1, wherein said lubricating oil has an SUS viscosity at 100° F of between about 50 and 300.

* * * * *